US006994339B2

(12) United States Patent
Kato et al.

(10) Patent No.: US 6,994,339 B2
(45) Date of Patent: Feb. 7, 2006

(54) SHEET STACKING-ALIGNING APPARATUS, SHEET PROCESSING APPARATUS AND IMAGE FORMING APPARATUS

(75) Inventors: Katsuhito Kato, Ibaraki (JP); Daisaku Kamiya, Chiba (JP); Daiju Yoshino, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/429,804

(22) Filed: May 6, 2003

(65) Prior Publication Data

US 2003/0214090 A1 Nov. 20, 2003

(30) Foreign Application Priority Data

May 17, 2002 (JP) ..... 2002-143060

(51) Int. Cl.
*B65H 37/04* (2006.01)

(52) U.S. Cl. ..... 270/58.12; 270/58.11; 270/58.16; 270/58.17; 399/410; 271/221

(58) Field of Classification Search ..... 270/58.12, 270/58.16, 58.17, 58.08, 58.11; 399/410; 271/221, 222, 223, 224
See application file for complete search history.

(56) References Cited

U.S. PATENT DOCUMENTS 3,749,398 A * 7/1973 Fujita et al. ..... 271/180
5,020,784 A * 6/1991 Asami et al. ..... 270/58.11
5,054,764 A * 10/1991 Phillips et al. ..... 271/189
5,282,611 A 2/1994 Ueda et al. ..... 270/53
5,409,202 A * 4/1995 Naramore et al. ..... 270/58.12
5,700,002 A 12/1997 Kato et al. ..... 270/58.12
5,897,250 A 4/1999 Hirai et al. ..... 399/404
6,142,461 A * 11/2000 Asao et al. ..... 270/58.09
6,257,571 B1 * 7/2001 Kniss et al. ..... 271/181
6,398,214 B1 6/2002 Moteki et al. ..... 271/220
6,427,997 B1 * 8/2002 Hirota et al. ..... 270/58.12
6,471,429 B1 10/2002 Isobe et al. ..... 400/582
6,491,492 B1 * 12/2002 Cook ..... 414/789.9
6,572,101 B2 * 6/2003 Kaya et al. ..... 271/210
6,666,444 B1 * 12/2003 Paoli ..... 270/58.11
6,705,603 B1 * 3/2004 Kirino et al. ..... 270/12

FOREIGN PATENT DOCUMENTS

JP 2000153954 A * 6/2000

* cited by examiner

*Primary Examiner*—Patrick Mackey
(74) *Attorney, Agent, or Firm*—Fitzpatrick, Cella, Harper & Scinto

(57) ABSTRACT

The sheet stacking-aligning apparatus or the sheet processing apparatus includes a substantially horizontal stacking tray, a rear end aligning unit for aligning a rear end of a sheet bundle on the stacking tray, and a control unit for controlling an operation of the rear end aligning unit for aligning the sheet bundle when it is in an upstream position of the stacking tray, and the stacking tray is provided substantially horizontally. It is thus made possible to increase the stacking space, thereby increasing the number of stackable sheets and to achieve the alignment of the rear end of the sheet bundle with a simple configuration, thereby improving the stacking-aligning property of the sheet bundle on the stacking tray.

14 Claims, 14 Drawing Sheets

SHEET STACKING-ALIGNING APPARATUS, SHEET PROCESSING APPARATUS AND IMAGE FORMING APPARATUS

BACKGROUND OF THE INVENTION

1. Field of the Invention

The present invention relates to a sheet stacking-aligning apparatus for aligning and stacking sheets, a sheet processing apparatus provided with such sheet stacking-aligning apparatus, and an image forming apparatus provided with such sheet processing apparatus. In particular, the present invention provides a sheet stacking-aligning apparatus with an improved stacking-aligning ability for a sheet bundle, one that is capable of achieving a space saving, a cost reduction and an increase in the capacity of the number of stacked sheets, a sheet processing apparatus provided with such sheet stacking-aligning apparatus, and an image forming apparatus provided with such sheet processing apparatus.

2. Related Background Art

In an image forming apparatus such as a printing press, a copying apparatus or a printer, sheets S subjected to image formation in a main body of the image forming apparatus are temporarily stacked on a process tray 140 in a sheet processing apparatus 100, and there are executed sheet post-processes such as alignment and stapling of the sheet S. Thereafter a bundle is discharged by bundle discharge means 108 onto a stacking tray 400 having an inclined stacking surface as shown in FIG. 10. The discharged sheets S move by its own weight on the inclined stacking surface of the stacking tray 400, and rear ends (trailing edges) of the sheets are aligned on a rear end (trailing edge) aligning wall. The number of stacking sheets S is dependent on a vertically movable stroke of the stacking tray 400.

Also in a sheet processing apparatus as shown in FIG. 12, a bundle of sheets S is conveyed by a gripper 401 of bundle discharge means to a box-shaped stacking tray 400 having a horizontal stacking surface and stacked therein.

Also in a sheet processing apparatus in which a stacking tray 400 has a conventional horizontal stacking surface as shown in FIG. 13, a rotation of a sheet returning paddle 501 causes the sheets S to be stacked with the rear ends thereof aligned.

However, in case of stacking sheets of low rigidity or showing a downward curl on the stacking tray 400 having a conventional inclined stacking surface as shown in FIG. 10, there may result a buckling of the sheets caused by a weight thereof because of a steep inclination, thereby deteriorating the aligning property.

Also in case of stacking stapled sheet bundles S on the stacking tray 400 having the conventional inclined stacking surface as shown in FIG. 11, a rear end of a sheet bundle S may catch on a staple of an already stacked sheet bundle S so that it cannot slide to a rear end aligning wall 70, whereby the stacking property is deteriorated.

Also in the sheet processing apparatus as shown in FIG. 12, the gripper 401 is indispensable as the bundle discharge means, and a combination thereof with the box-shaped stacking tray 400 having a horizontal stacking surface renders the entire apparatus bulky and expensive.

Also in the sheet processing apparatus in which the stacking tray 400 has a horizontal stacking surface as shown in FIG. 13, the alignment by the sheet returning paddle 501 is effective only for the uppermost sheet, whereby the discharge of sheets in a bundle is not possible.

SUMMARY OF THE INVENTION

An object of the present invention is to improve stacking-aligning property for stacked sheet bundle with a simple configuration, and to increase a capacity for the number of stacked sheets while achieving downsizing of the apparatus.

For attaining the above-mentioned objective, a representative configuration of the present invention is featured by including stacking means which stacks sheets or sheet bundles, sheet rear end aligning means which achieves alignment by pressing a rear end of sheets or sheet bundles conveyed onto the stacking means, sheet conveying means which conveys sheets or sheet bundles onto the stacking means, and control means which actuates the sheet rear end aligning means at a timing when the rear end of the sheet or the sheet bundle, conveyed by the sheet conveying means, is positioned at an upstream side of the stacking means, thereby aligning the rear end of the sheets or the sheet bundles.

Also the above-mentioned configuration includes a processing tray for temporarily stacking sheets for a sheet post-process, wherein the sheet or the sheet bundle subjected to the post-process in the processing tray is conveyed by the aforementioned sheet conveying means to the stacking means.

As explained in the foregoing, the present invention allows for improvement of the sheet aligning properties even in cases where the stacking tray is made substantially horizontal, whereby a space corresponding to the inclination of the ray can be utilized for a vertical stroke, thus increasing a capacity of the number of sheets stackable on the stacking tray. Also a space saving and a cost reduction can be achieved since a box-shaped stacking tray or a gripper for bundle movement is not employed.

Also, since the stacking on the stacking trays is achieved with an alignment in the sheet conveying direction by conveying a sheet bundle until a rear end thereof reaches an upper end of a rear end aligning wall thereby causing the rear end to impinge on an upper end of a rear end reference wall, and pressing the rear end of the sheet bundle by the rear end aligning wall, whereby it is rendered possible to avoid positional aberrations of the front end and the rear end of the sheet bundle in the conveying direction and to improve the stacking and aligning of the sheet bundles on the stacking tray.

Further, since the stacking tray can be positioned with a smaller inclination, it is rendered possible to prevent a buckling phenomenon resulting from a weight of a bundle of sheets.

Further, in the present invention, as the rear end of a discharged sheet bundle is aligned to the already stacked sheet bundles, at an upstream side in the discharge direction, it is possible to prevent a positional aberration resulting from trapping of the rear end of the discharged sheet bundle by a staple of the already stapled and stacked sheet bundles.

DETAILED DESCRIPTION OF THE PREFERRED EMBODIMENTS

In the following there will be given a detailed description of an embodiment of the sheet stacking-aligning apparatus, sheet processing apparatus and image forming apparatus embodying the present invention, with reference to accompanying drawings.

(First Embodiment)

Figure 1:
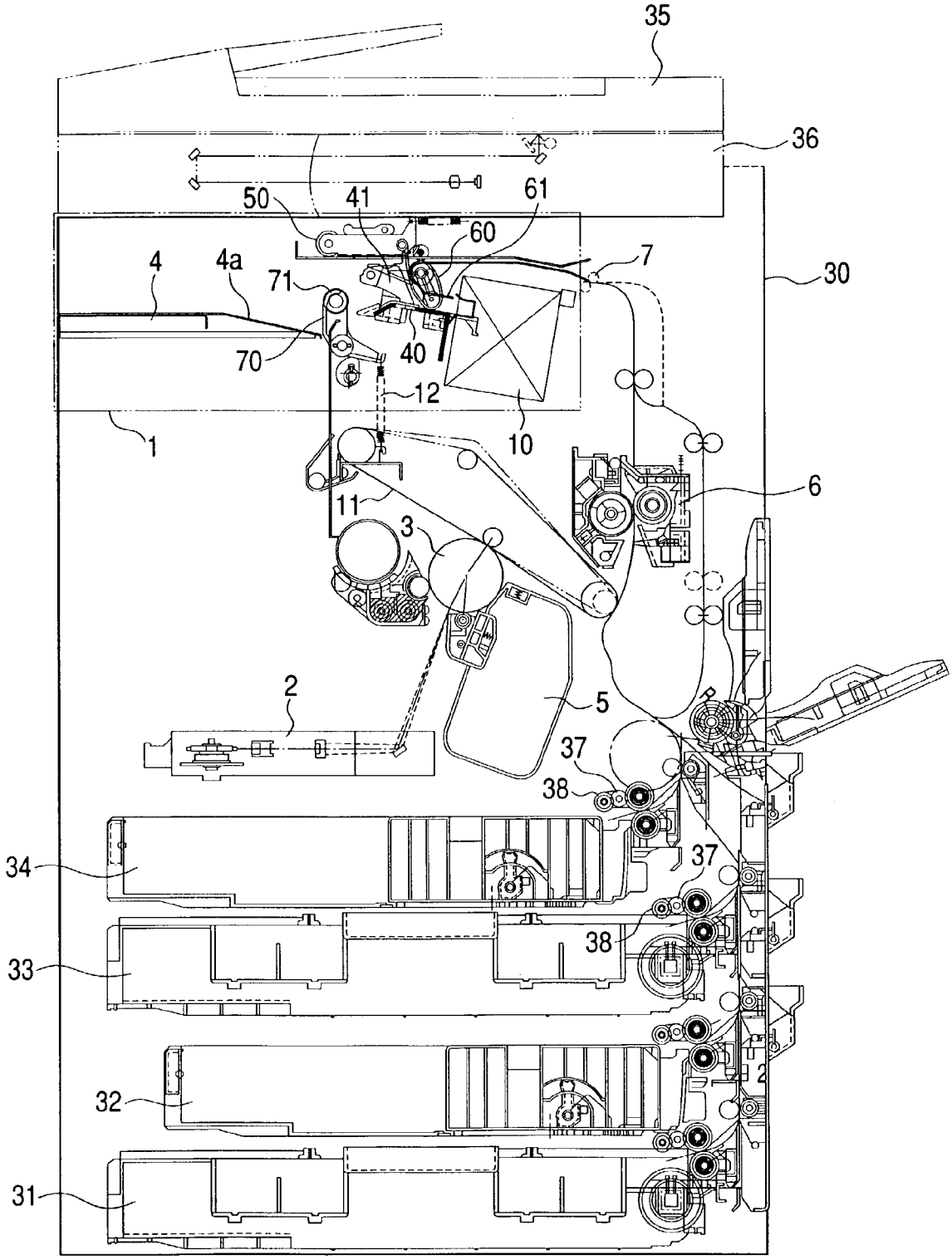
FIG. 1 is a schematic cross-sectional view showing the entire configuration of a sheet processing apparatus constituting first and second embodiments.
Figure 2:
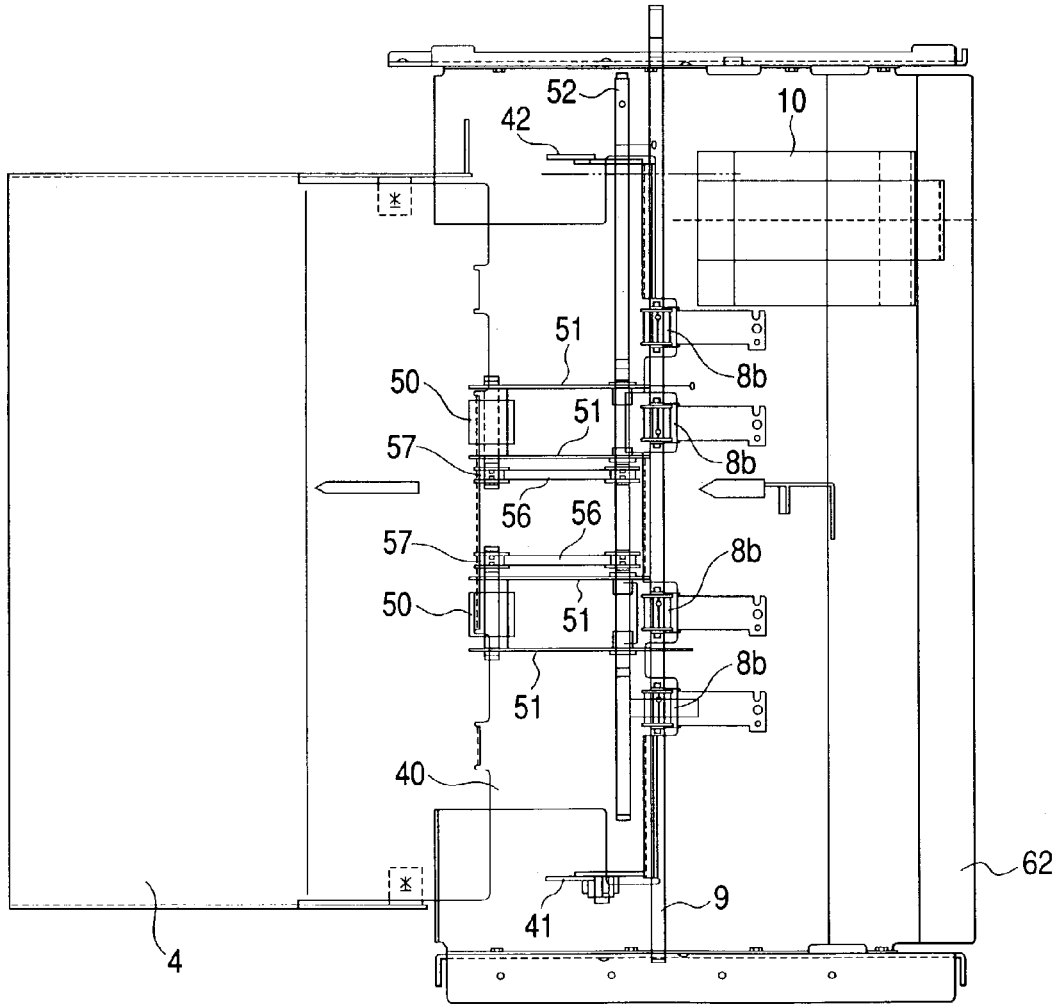
FIG. 2 is a plan view of a sheet stacking-aligning apparatus.
Figure 3:
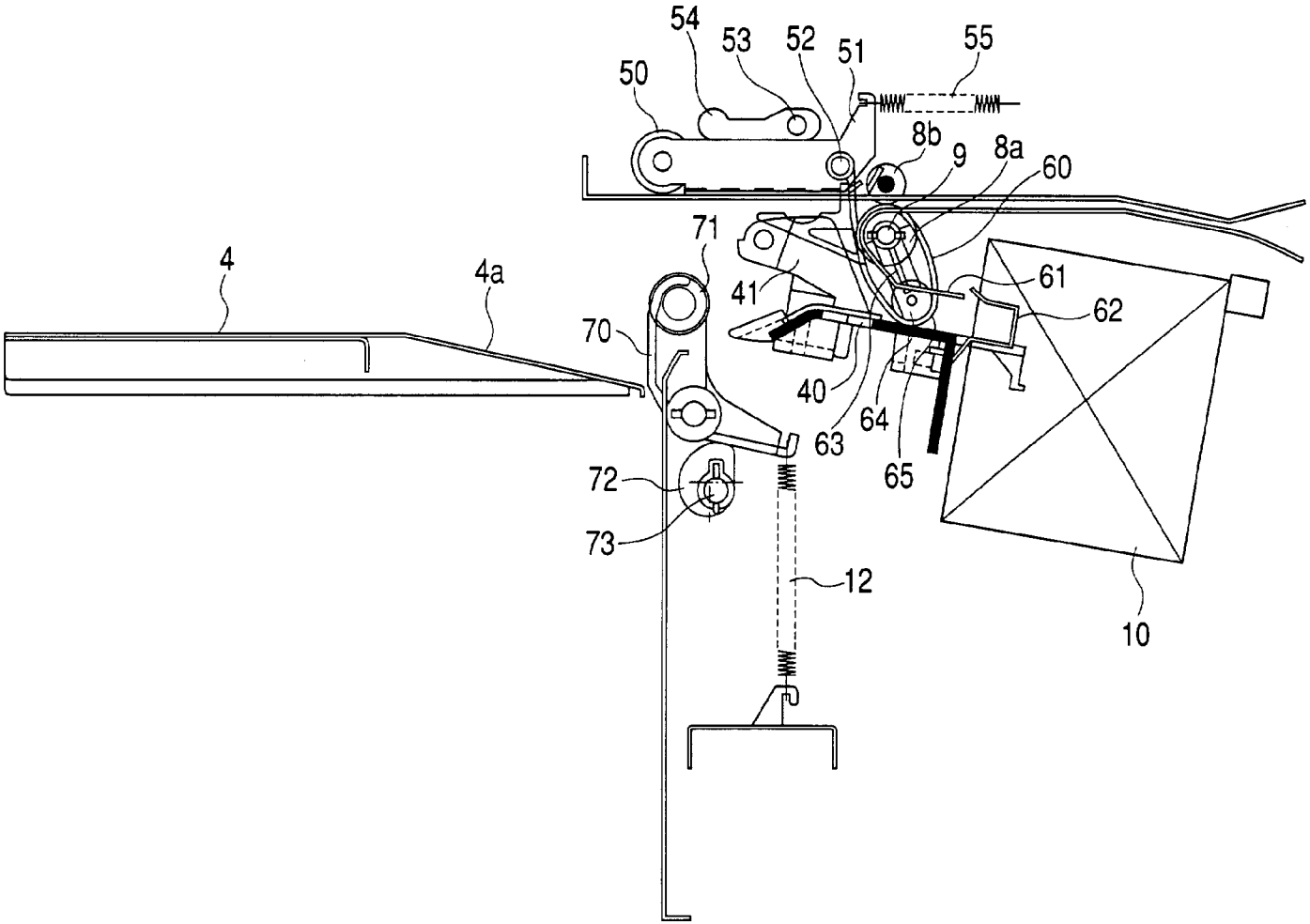
FIG. 3 is a cross-sectional view showing moving mechanisms for a rocking roller and an alignment member provided in a processing tray.

In the following, there will be given a detailed explanation on an embodiment of the image forming apparatus of the present invention, with reference to the accompanying drawings. FIG. 1 is a cross-sectional view of a main body 30 of an image forming apparatus equipped with a sheet processing apparatus 1 constituting a first embodiment of the present invention, FIG. 2 is a plan view of the sheet processing apparatus 1, and FIG. 3 is a cross-sectional view of the sheet processing apparatus 1.

The following description will be given of an example of the sheet processing apparatus 1, which is provided in the main body 30 of the image forming apparatus and under an original reading apparatus as shown in FIG. 1, and which temporarily stacks sheets S, discharged after image formation, to a process tray 40, and, after post processes such as alignment and stapling, stacks and aligns the processed sheets S on a substantially horizontal stacking tray.

However, the present invention is also effective in a configuration in which the sheet stacking-aligning apparatus for aligning and stacking the sheets S, discharged after image formation from the main body 30 of the image forming apparatus, on the stacking tray 4 is directly connected to the main body 30 of the image forming apparatus without the process tray 40, or in a configuration in which the aforementioned sheet processing apparatus 1 is mounted outside the main body 30 of the image forming apparatus.

Referring to FIG. 1, a numeral 1 indicates a sheet processing apparatus of the present invention mounted in the main body 30 of the image forming apparatus, and an automatic original reading apparatus 35 is mounted in an upper part of the main body 30 of the image forming apparatus. The image forming apparatus of the present invention is comprises the main body 30 of the image forming apparatus, the sheet processing apparatus 1 and the automatic original reading apparatus 35, but the process tray 40 may be dispensed with in the sheet processing apparatus 1.

In the main body 30 of the image forming apparatus, as shown in FIG. 1, an original is automatically supplied by the automatic original reading apparatus 35 to a reading position and an image is read by an image reading unit 36. Then, based on read image information, a controller (not shown) sends a signal to a laser scanner unit 2 whereby a laser light is emitted.

The laser light is reflected by a rotating polygon mirror, further reflected by a mirror and irradiates a photosensitive drum 3 constituting image forming means of which surface is uniformly charged, thereby forming an electrostatic latent image. The electrostatic latent image on the photosensitive drum 3 is developed by a developing device 5, and is transferred as a toner image onto a sheet S which is constituted by paper or an OHP sheet.

The sheet S is selectively advanced from sheet cassettes 31, 32, 33, 34 by pickup rollers 38, constituting sheet feeding means, separated and fed one by one by separating means 37, and, after correction of skewing by a pre-registration roller pair, advanced to a transfer position in synchronization with the rotation of the photosensitive drum 3, whereby the toner image formed on the photosensitive drum 3 is transferred via a transfer belt 11 to the sheet S.

Thereafter the sheet S is guided to a paired fixing rollers 6, and given heat and pressure by the paired fixing rollers 6 whereby the toner image transferred to the sheet S is permanently fixed thereon. The paired fixing rollers 6 are in contact respectively with an upper separating claw and a lower separating claw, whereby the sheet S is separated from the paired fixing rollers 6.

The separated sheet S is conveyed by paired discharge rollers 7 of the main body to the exterior of the main body 30 of the image forming apparatus, and is guided to a sheet processing apparatus 1 connected to the main body 30 of the image forming apparatus.

Referring to FIG. 1, the sheet processing apparatus 1 is constituted by a process tray 40 constituting sheet stacking means positioned at an upstream side, and a stacking tray 4 provided substantially horizontally at a downstream side, and the sheet S discharged from the paired discharge rollers 7 of the main body 30 of the image forming apparatus is subjected to a post-process in the process tray 40 and is then stacked on the stacking tray 4.

As shown in FIGS. 2 and 3, the sheet S discharged from the image forming apparatus 30 is discharged toward the stacking tray 4 by a discharge unit 8 constituted by a discharge roller 8*a* of the sheet processing apparatus 1 and an idler discharge roller 8*b*, but, at a time when a rear end of the sheet S passes through the discharge unit 8, the rear end of the sheet S is lowered by a rocking roller 50 and is pinched between the rocking roller (oscillating roller) 50 and an idler roller 71.

Thereafter, the rocking roller 50 reversely rotates whereby the rear end of the sheet S is guided, in a direction opposite to the prior conveying direction, along a lower guide 61 to the process tray 40, and an alignment in the sheet conveying direction and in the sheet transversal direction is executed for each sheet.

The alignment in the sheet conveying direction is achieved, by the weight of the sheet S obtained from the inclination angle of the process tray 40 and by a return belt 60, by causing the sheet S to impinge on a rear end stopper 62 which is positioned at an end of the process tray 40 and constitutes sheet receiving means for receiving the sheet S on the process tray 40, while the alignment in the sheet transversal direction is achieved by aligning plates 41, 42 which are operated by unshown control means (for example a rack and a pinion gear drive source).

In case a stapling mode is selected, a stapler unit 10 executes a stapling on an aligned sheet bundle S. The sheet bundle S thus subjected to a post-process is discharged and stacked on the stacking tray 4 by a counterclockwise rotation of the rocking roller 50.

In the following a detailed description will be given on the configuration of the sheet processing apparatus 1.

<Rocking Roller (Oscillating Roller)>

The function of the rocking roller 50 will be explained with reference to FIGS. 2, 4A, 4B and 14. The rocking roller (oscillating roller) 50 functions to press the rear end of the discharged sheet 2 and to drop the rear end portion of the sheet S onto the process tray 40.

Figure 4A:
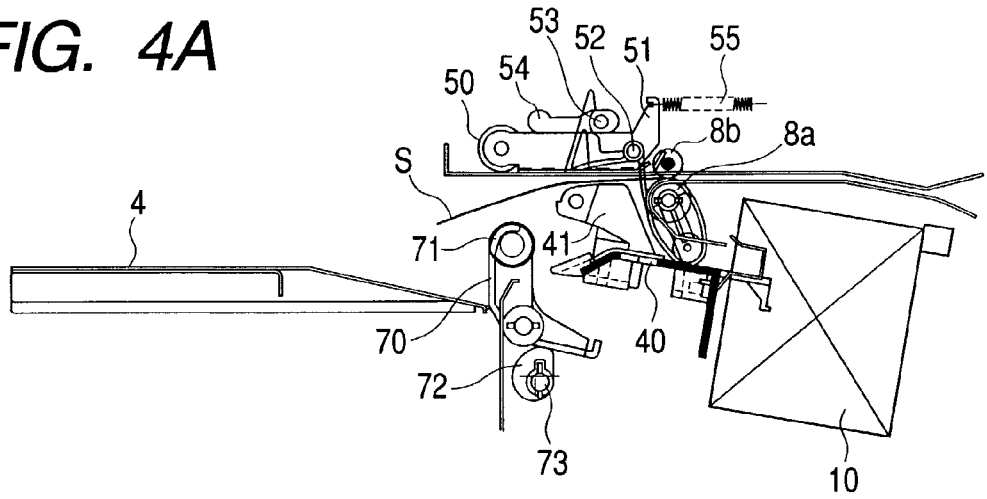
FIGS. 4A, 4B and 4C are cross-sectional views showing functions of the rocking roller.
Figure 4B:
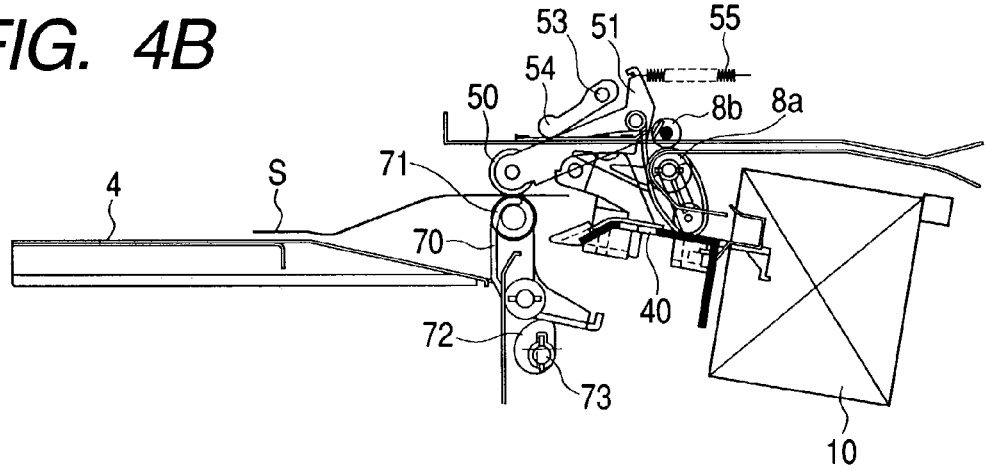
Figure 4C:
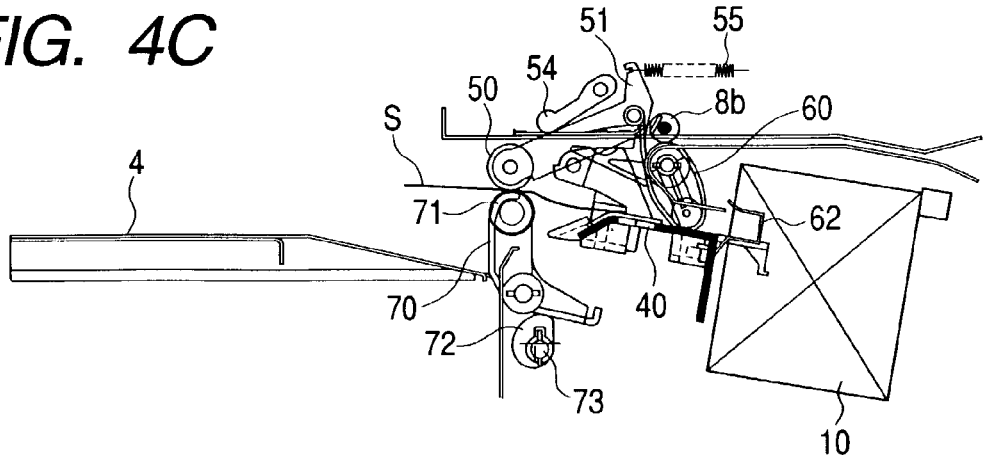
Figure 14:
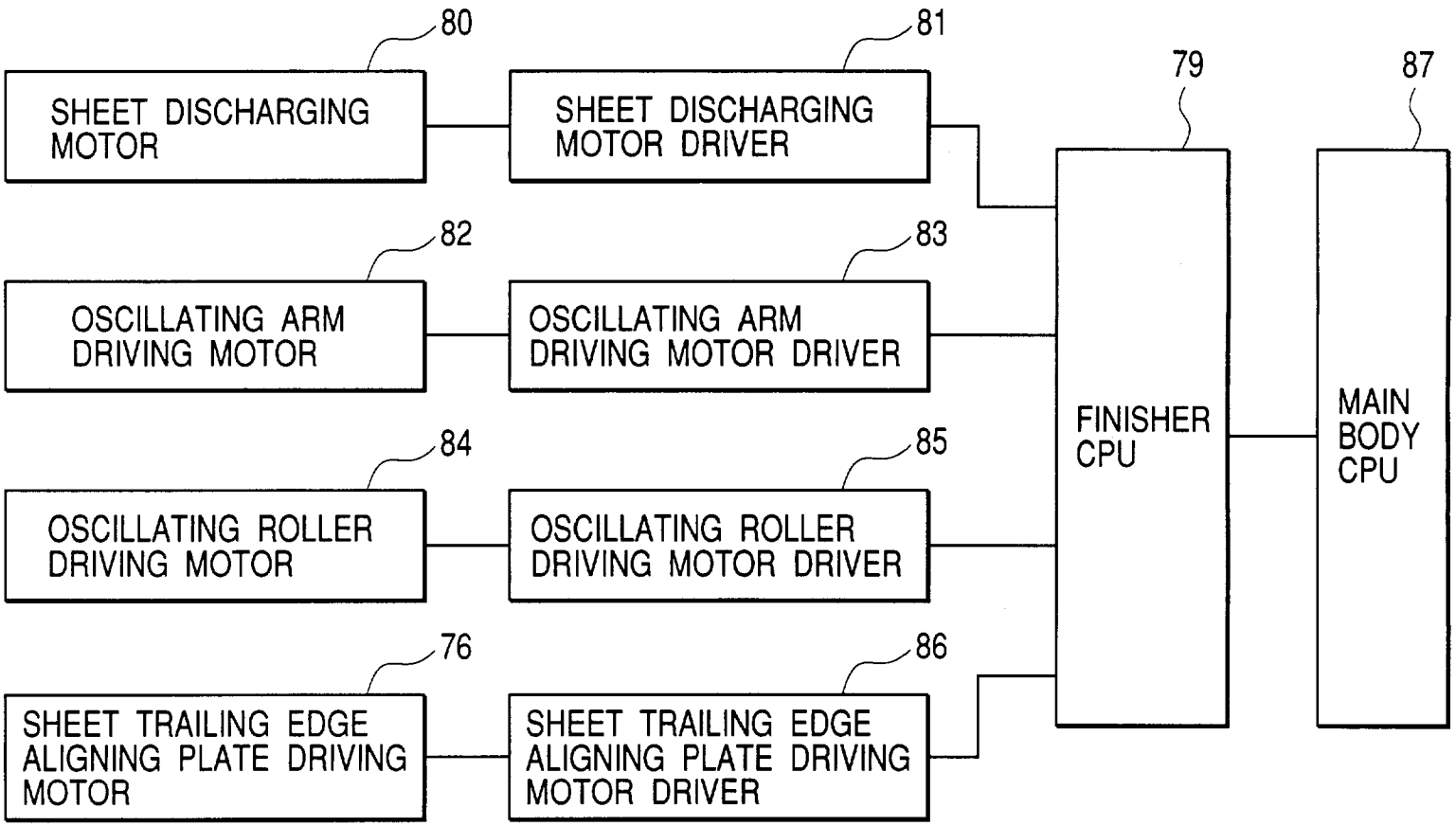
FIG. 14 is a block diagram of a sheet processing apparatus of the first and second embodiments.

As shown in FIGS. 4A, 4B, and 4C, the rocking roller 50 is mounted on a rocking arm (oscillating arm) 51 which is capable of a vertical rocking motion about a rocking roller shaft 52. A driving force is transmitted from a rocking arm drive motor 82 to a rocking arm shaft 53 through a rocking cam 54, and a drive signal from a finisher CPU 79 is transmitted to the rocking arm drive motor 82 through a rocking arm drive motor driver 83 (FIG. 14). A rotation of the rocking arm drive motor 82 causes the rocking arm 51 to execute a vertical rocking motion about the rocking roller shaft 52, integrally with the rocking cam 54 (oscillating cam). The rocking arm 51 is provided with a rocking arm tension spring 55 for assisting an upward rocking motion.

The rocking roller 50 is connected to the rocking roller shaft 52 and the rocking roller drive motor 84 via a rocking timing belt 56 and a rocking pulley 57, and rotates counterclockwise when a drive signal is transmitted from the finisher CPU 79 to a rocking roller drive motor 84 through a rocking roller drive motor driver 85.

The rocking roller 50 has a home position not in contact with the sheet S discharged by the discharge unit 8 onto the process tray 40 (FIG. 4A). When the sheet S is discharged from the discharge unit 8, the rocking arm 51 rotates counterclockwise by the rocking arm drive motor 82 about the rocking roller shaft 52, thereby lowering the rocking roller 50 to press down the rear end of the sheet S by the rocking roller 50 onto the process tray 40 (FIG. 4B).

Then the rocking roller 50 forms a nip with the idler roller (following roller) 71 and rotates counterclockwise by the rocking roller drive motor 84, thereby drawing in the sheet S until the rear end of the sheet S on the process tray 40 comes into contact with the return belt 60. Thereafter the rocking roller 50 is elevated again to the home position, thereby preparing for a next sheet discharge (FIG. 4C).

<Return Belt>

Figure 5A:
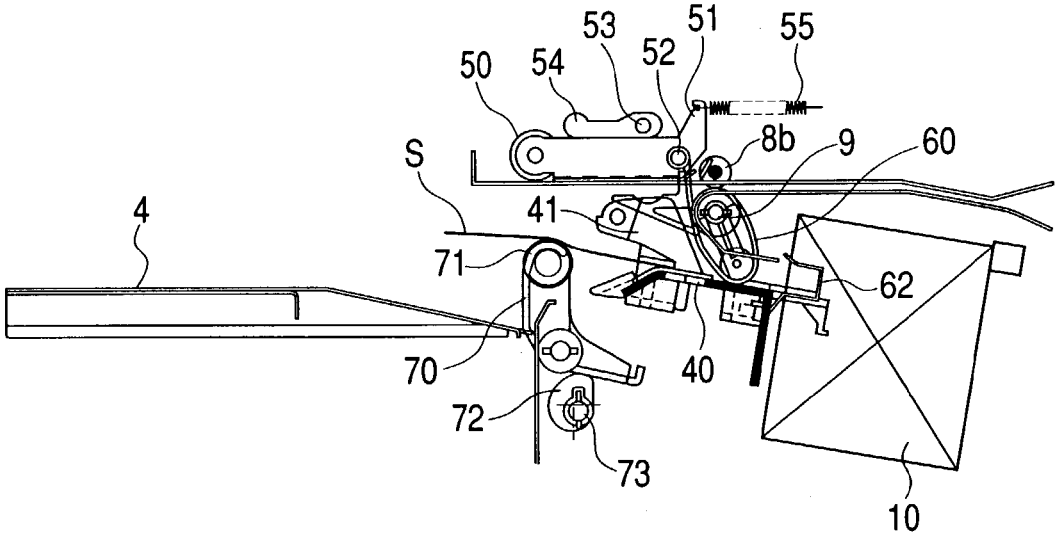
FIGS. 5A and 5B are cross-sectional views showing functions of a return belt.
Figure 5B:
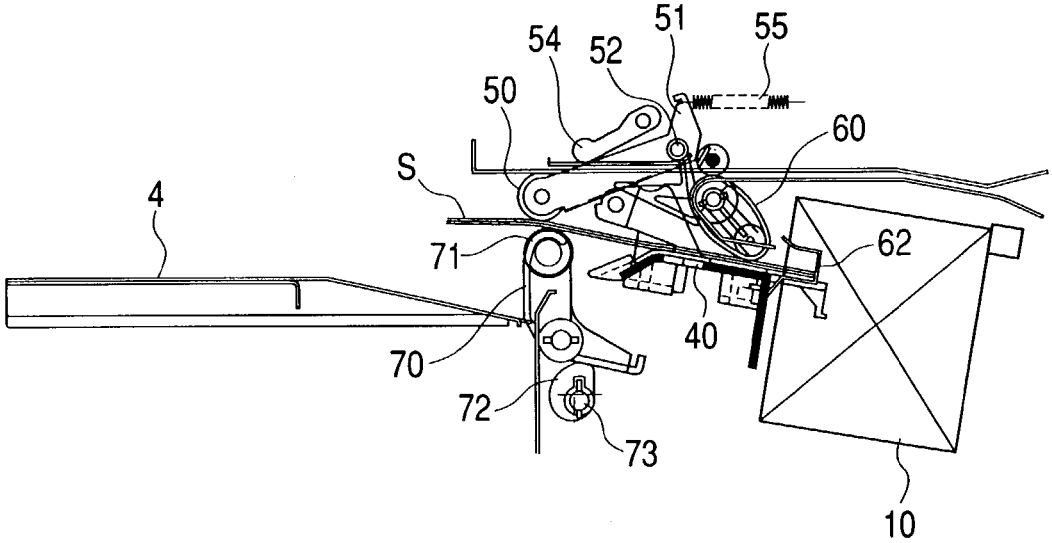

As shown in FIGS. 2, 5A and 5B, the return belt 60 is supported in a vertical direction by the discharge roller shaft 9, and is normally so positioned as to be in contact with the sheet S on the process tray 4. The return belt 60, constituting at least a sheet conveying rotary member positioned perpendicularly to an impinging direction of the sheet S onto the sheet rear end stopper 62, is constituted by a belt member 65 positioned between the sheet discharge roller 8*a* and a return belt pulley 64 supported by a housing 63 (FIG. 3), and the belt member 65 conveys the sheet S toward the sheet rear end stopper 62 by a counterclockwise rotation of the discharge roller shaft 9 (FIG. 5A).

Also the return belt 60 is constructed so as to deflect in a direction of the thickness of the sheets S, according to the number of the sheets S stacked on the process tray 40 (FIG. 5B).

<Bundle Discharge Means>

Figure 6A:
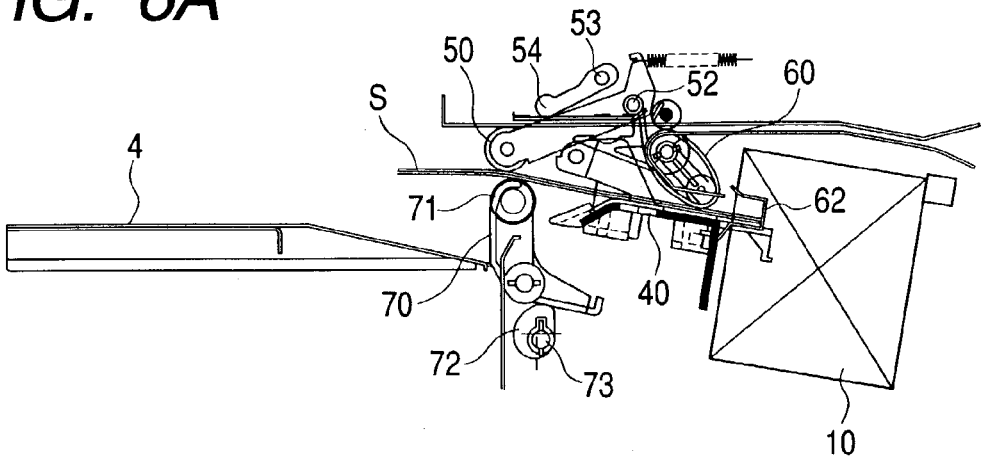
FIGS. 6A, 6B and 6C are cross-sectional views showing a discharge operation for a sheet bundle.
Figure 6B:
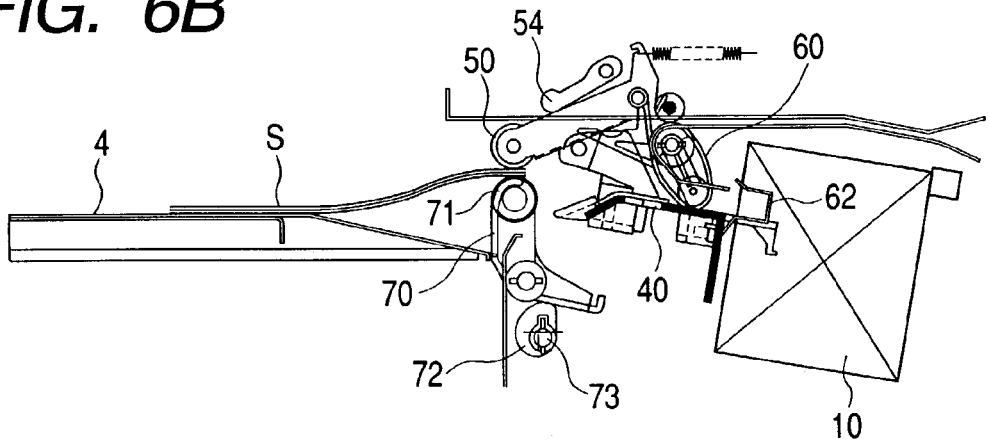

An explanation will now be given of the bundle discharge means, with reference to FIGS. 6A, 6B and 6C. The return belt 60 draws in a last sheet S until it comes into contact with the rear end stopper 62, and the rocking roller 50 is lowered under the drive of the rocking arm drive motor 84 and about the rocking roller shaft 52 until it comes into contact with the sheet bundle S (FIG. 6A), and, after forming a nip with the idler roller 71, rotates clockwise to convey the sheet bundle S, aligned or stapled on the process tray 40, until a rear end thereof reaches a vicinity of an upper end of a rear end aligning wall 70 and stops the sheet bundle in such position (FIG. 6B).

Figure 6C:
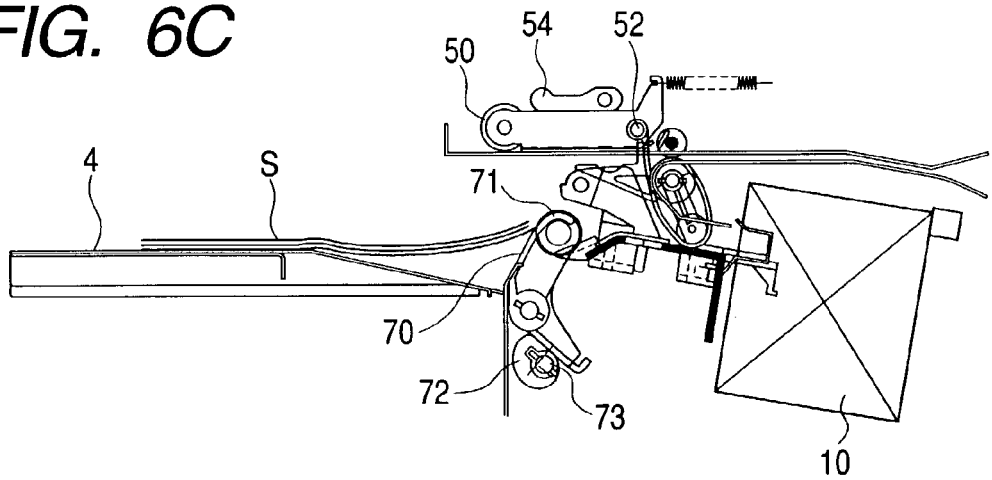

Thereafter the rocking roller 50 is separated from the sheet bundle S and returns to the home position (FIG. 6C). At the same time the rear end aligning wall 70 moves, about the cam rocking rotation shaft 73, in a direction opposite to the sheet conveying direction by a cam 72 positioned under the rear end aligning wall 70.

<Alignment of Sheet Rear End>

Figure 7A:
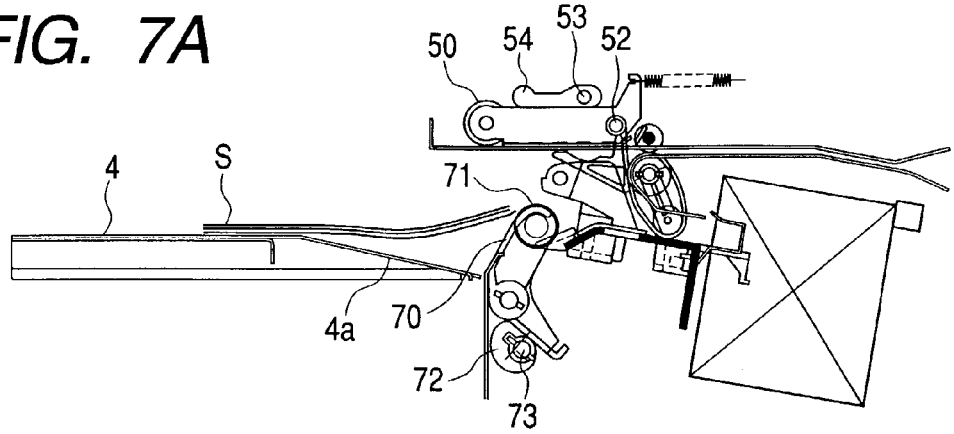
FIGS. 7A, 7B and 7C are cross-sectional views showing an aligning operation for a rear end of a sheet bundle in the first embodiment.
Figure 7B:
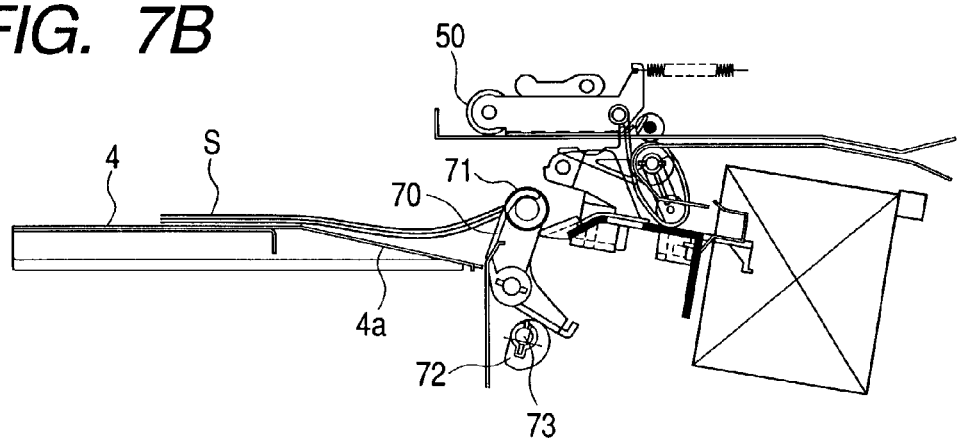
Figure 7C:
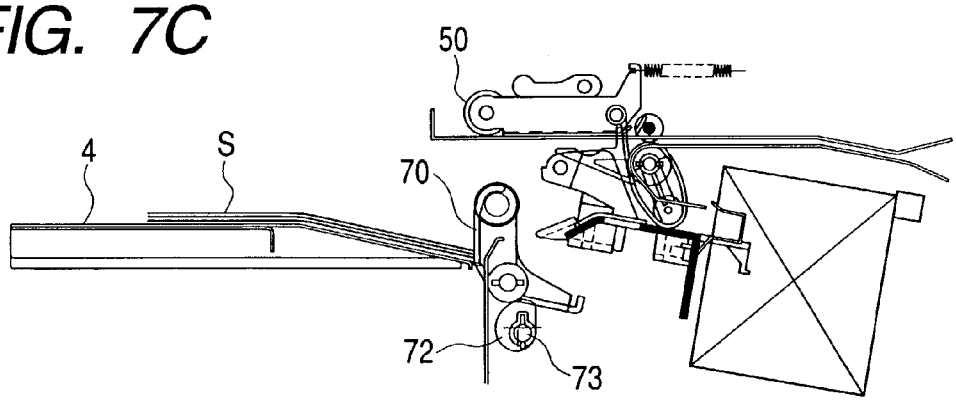

In the following there will be explained, with reference to FIGS. 7A, 7B and 7C, means for discharging the sheet bundle S from the process tray 40 onto the stacking tray 4 and aligning and stacking the sheet bundle thereon. As shown in FIGS. 7A, 7B and 7C, the rear end aligning wall 70 serves as an aligning wall for aligning the rear end of the sheet bundle S at the discharge and stacking of the sheet bundle S from the process tray 40 onto the stacking tray 4. The rear end aligning wall 70 is placed in an alignment reference position by a biasing with a spring 12 and a contact with the cam 72 in a home position (FIG. 3).

When a drive signal is transmitted from the finisher CPU 79 through a rear end aligning wall drive motor driver 86 to a rear end aligning wall drive motor 76 to cause a rotation thereof, the rear end aligning wall 70 exerts a rocking motion in the sheet conveying direction by the cam 72, about the rocking rotation shaft 73 (FIGS. 7B and 14).

In a state where the rear end of the sheet bundle S discharged by the bundle discharge means impinges on the upper end of the rear end aligning wall 70 (FIG. 6B), the rear end aligning wall 70 is retracted to the upstream side in the sheet conveying direction (FIG. 6C), thereby causing the rear end of the sheet bundle S to impinge on an inclined face of the rear end aligning wall 70 (FIG. 7A). Then, in the course of returning thus retracted rear end aligning wall 70 to the home position about the rocking rotation shaft, the rear end of the sheet bundle S is aligned by pressing by the rear end aligning wall 70, whereby the sheet bundle S is stacked on the stacking tray 4 (FIGS. 7B and 7C).

In the present embodiment, the stacking tray 4 has a substantially horizontal stacking surface, but the sheet rear end aligning means also functions effectively when the sheet stacking surface is inclined, although it functions most effectively when the sheet stacking surface is substantially horizontal. Also the sheet stacking surface 4*a* is given a downward inclination angle of 18° or less toward the aforementioned sheet rear end aligning wall, thereby realizing a compactization of the apparatus while avoiding an interference between the rear end of a sheet bundle already stacked on the stacking tray 4 and a succeeding sheet bundle discharged from the process tray 40. Also, in order to maintain the uppermost surface of the stacked sheet bundles S at a constant height, the stacking tray 4 is rendered vertically movable by unrepresented drive means.

(Second Embodiment)

In the following there will be explained a second embodiment of the image forming apparatus 3 of the present invention, wherein components equivalent to those in the foregoing first embodiment are represented by same numbers and will not be explained further.

Figure 8A:
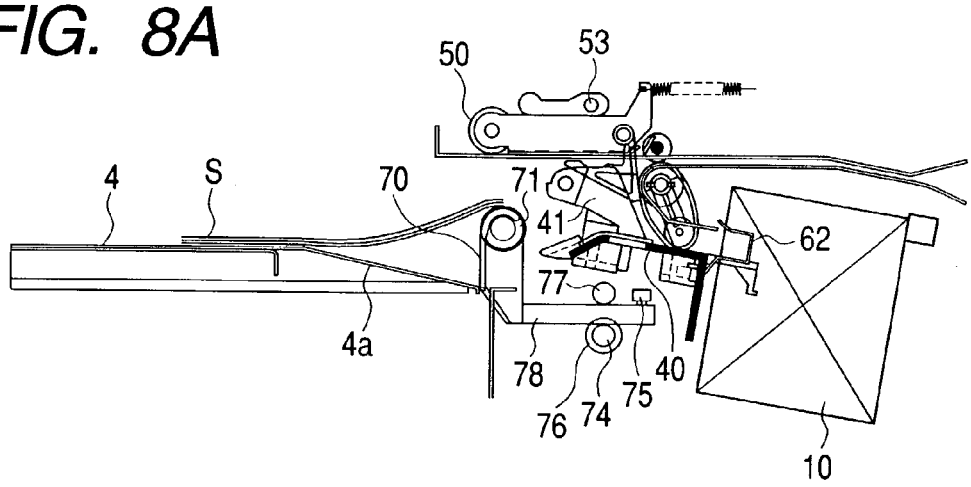
FIGS. 8A, 8B and 8C are cross-sectional views showing an aligning operation for a rear end of a sheet bundle in the second embodiment.
Figure 8B:
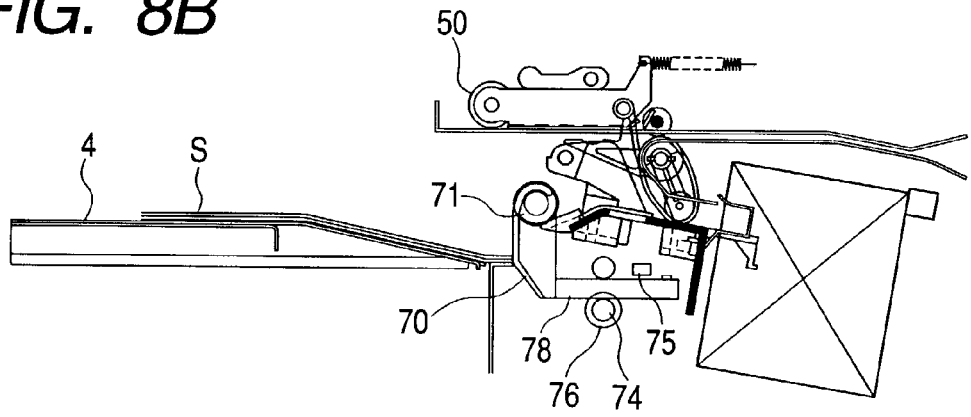
Figure 8C:
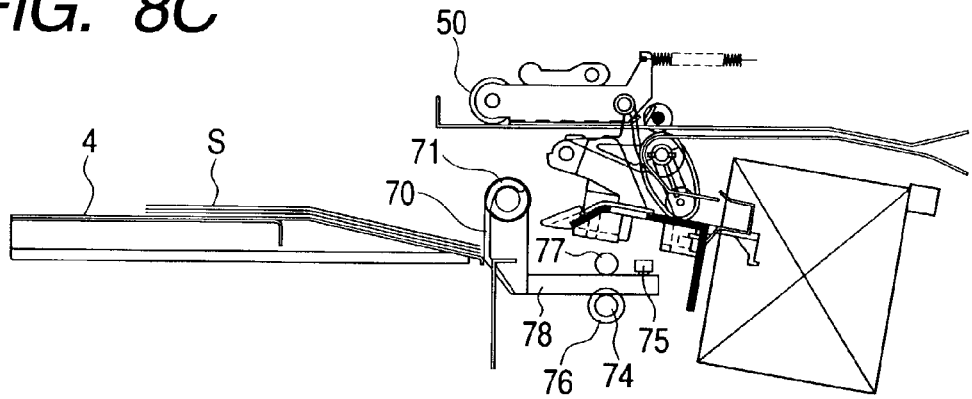
Figure 9:
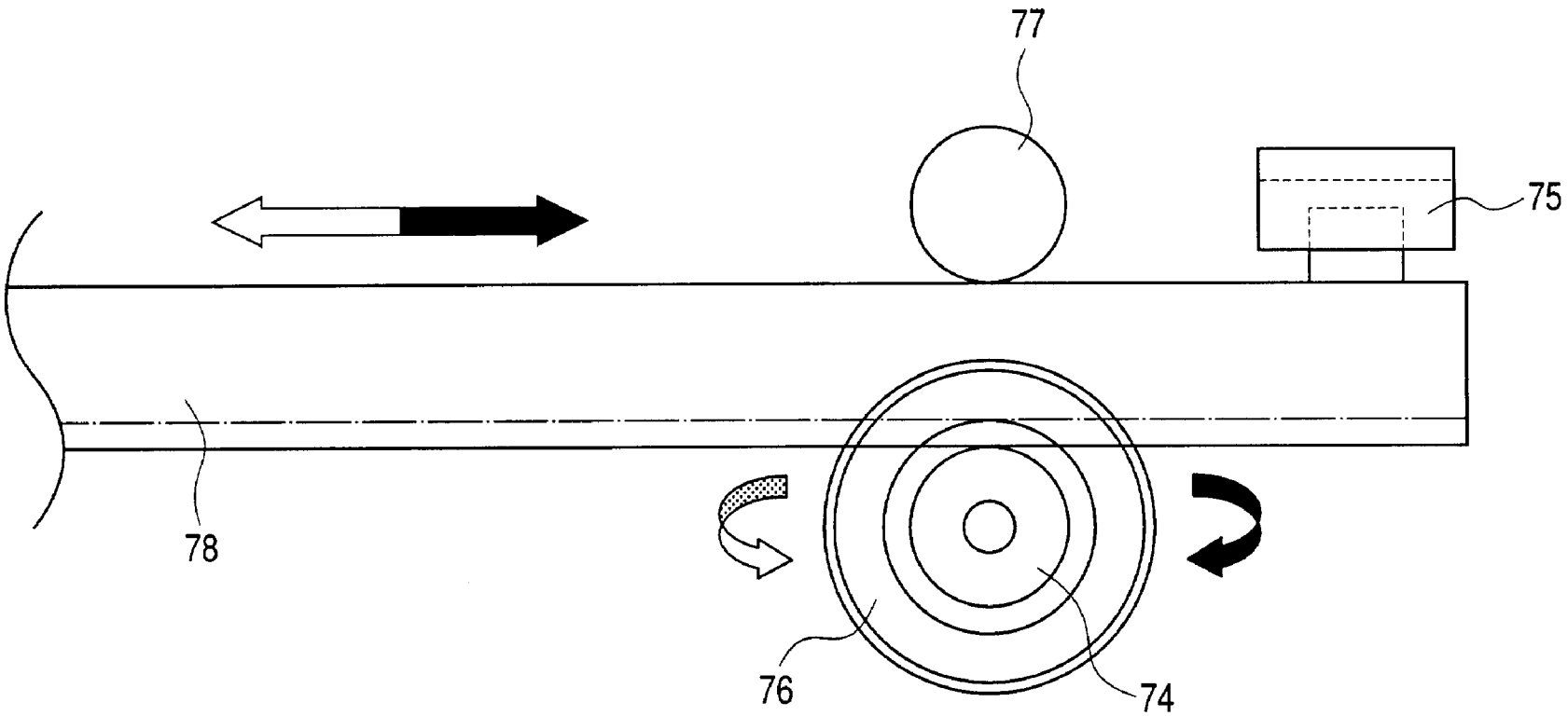
FIG. 9 is a magnified view showing a moving mechanism for a rear end aligning wall.
Figure 10:
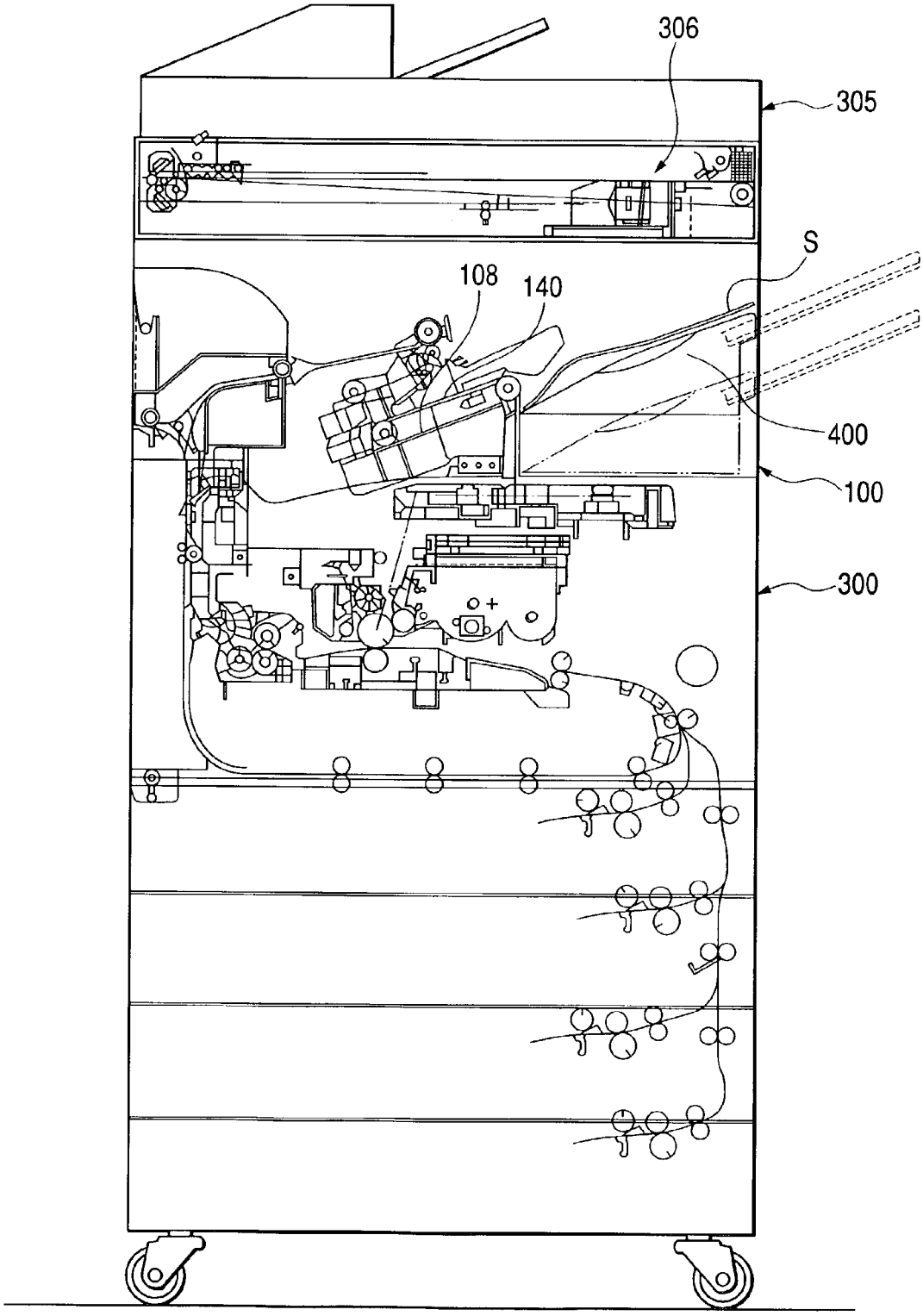
FIG. 10 is a cross-sectional view showing the entire configuration of a conventional sheet processing apparatus.
Figure 11:
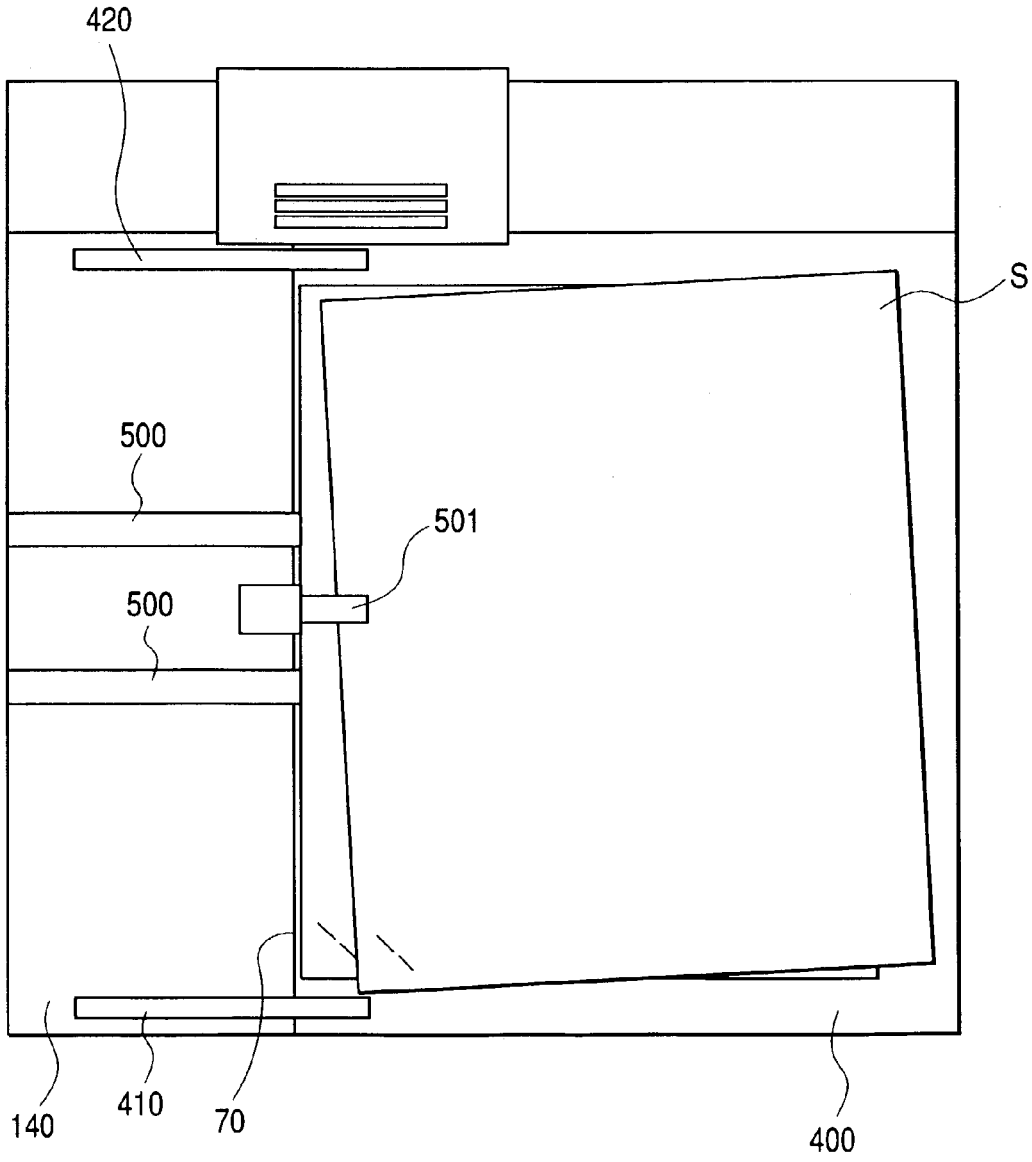
FIG. 11 is a plan view of a conventional sheet stacking-aligning apparatus.
Figure 12:
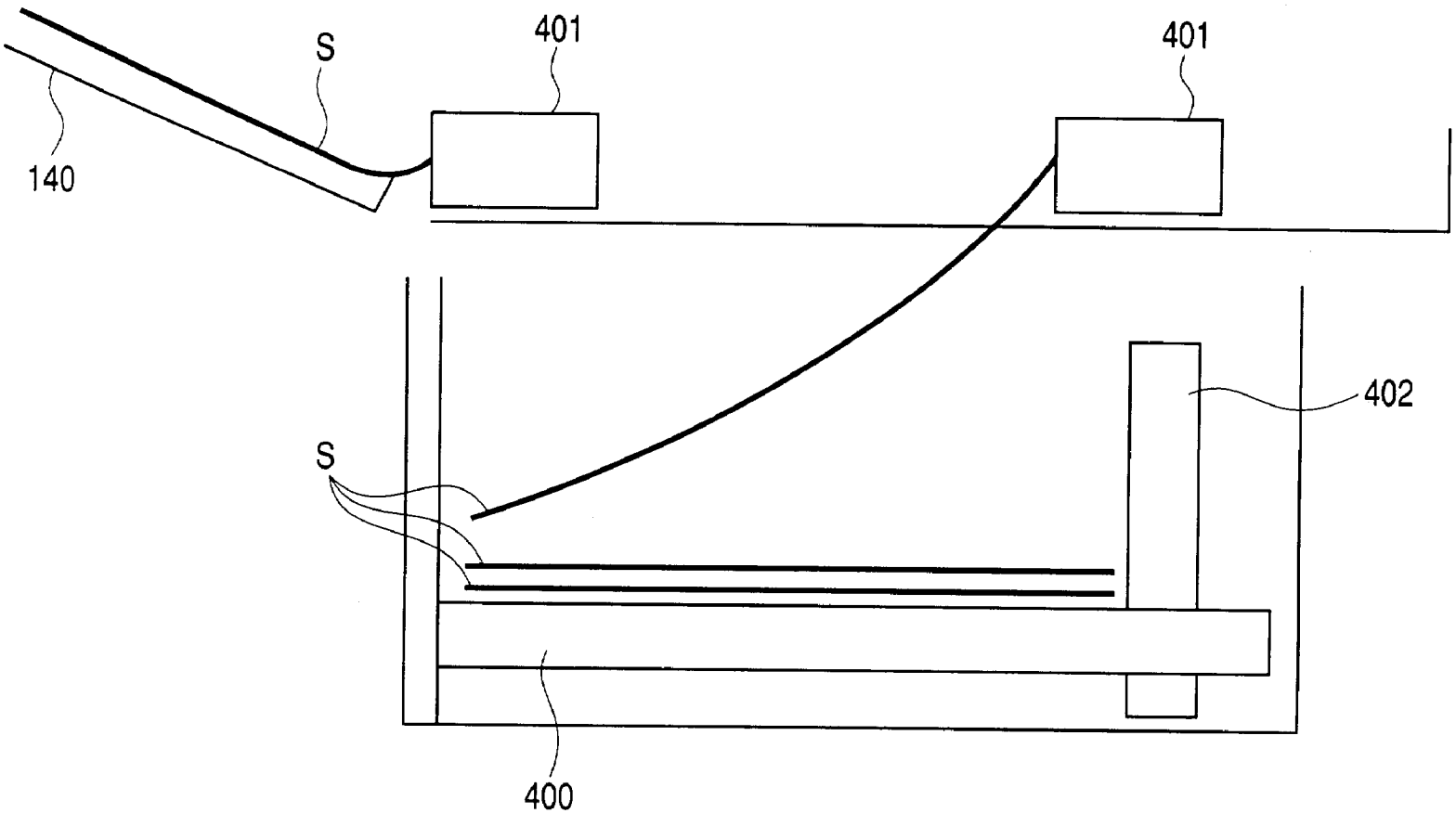
FIG. 12 is a cross-sectional view showing a sheet processing apparatus employing a conventional box-shaped horizontal stacking tray.
Figure 13:
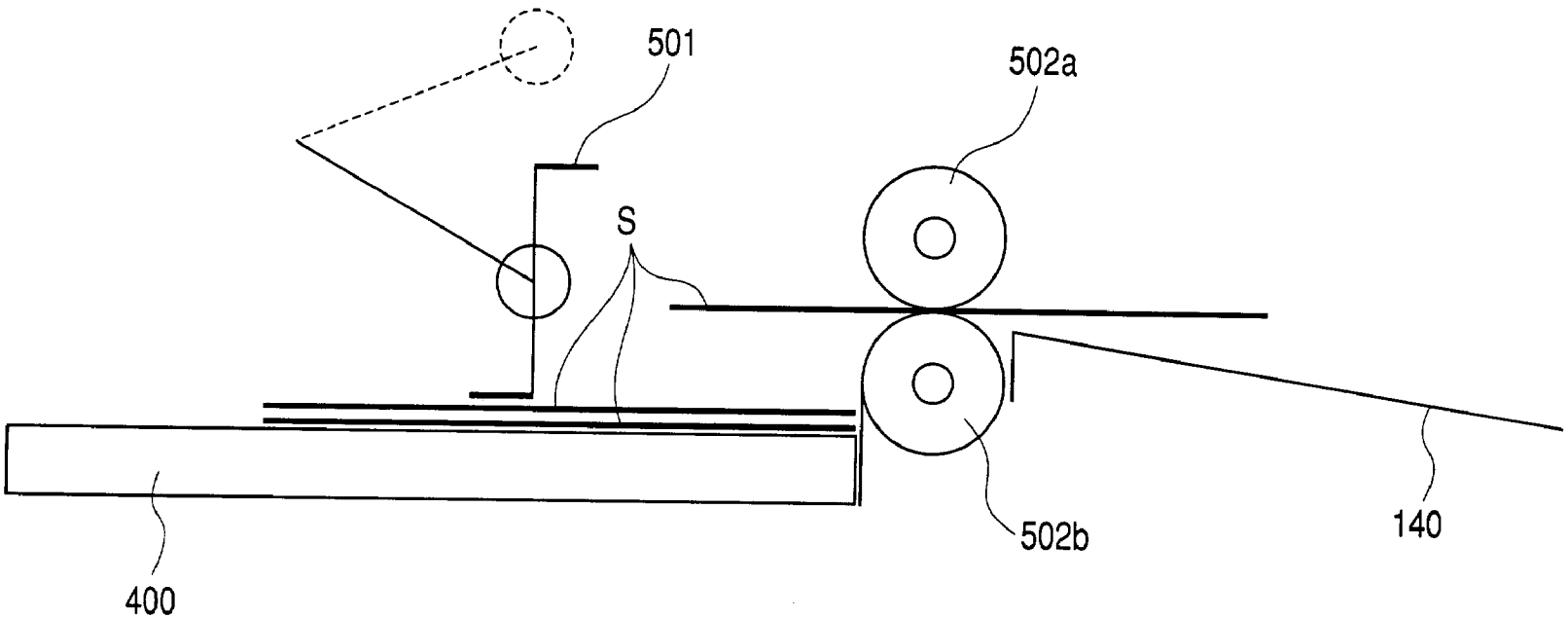
FIG. 13 is a cross-sectional view showing a sheet processing apparatus employing a horizontal stacking tray provided with a conventional sheet returning paddle mechanism.

In the following there will be given an explanation, with reference to FIGS. 8A, 8B and 8C, of means for discharging the sheet bundle S by parallel displacement of the rear end aligning wall 70 in the sheet conveying direction. As shown in FIGS. 8A, 8B and 8C, the rear end aligning wall 70 is provided with a rack gear 78 formed in the sheet conveying direction integrally with the rear end aligning wall 70, and exerts a parallel displacement in the sheet conveying direction by a driving force transmitted from the rear end aligning wall drive motor 76 through a pinion gear 74 to the rack gear 78 which is supported on the other side by a rack supporting roller 77. Also as shown in FIG. 9, a home position sensor 75 is provided for detecting the home position of the rear end aligning wall 70, and an amount of the movement of the rear end aligning wall 70 is controlled by counting a number of pulses for the rear end aligning wall drive motor.

In a state where the rear end of the sheet bundle S is stopped at the upper end of the rear end aligning wall 70 (FIG. 8A), the rear end aligning wall 70 is moved in a parallel displacement toward the upstream side in the sheet conveying direction thereby dropping sheet bundle S onto the stacking tray 4 (FIG. 8B). In this state, since the rear end of the sheet bundle S is placed in an upstream position, in the sheet conveying direction, of the home position of the rear end aligning wall 70, the rear end aligning wall 70 is further moved once toward the upstream side in the sheet conveying direction, then moved to the downstream side until it comes in contact with the rear end of the sheet bundle S and further moved to the home position of the rear end aligning wall 70, thereby aligning the rear end of the sheet bundle S and achieving the stacking of the sheet bundle S on the stacking tray 4.

What is claimed is:

1. A sheet processing apparatus comprising:

a process tray on which sheets are temporarily stacked, a post-process is executed; and a sheet stacking and aligning apparatus including:

a stacker on which the sheets or the sheet bundles conveyed from said process tray are stacked;

a conveyor which conveys a sheet or a sheet bundle; and a sheet rear end aligning unit which has a press portion movable between an aligning position to align a rear end of the sheet or a rear end of the sheet bundle by pressing the rear end of the sheet or the rear end of the sheet bundle and a retracted position upstream positioned from the aligning position in a conveying direction: and wherein after said conveyor conveys the sheet or the sheet bundle until the rear end of the sheet or the rear end of the sheet bundle reaches an upper end of the press portion in the aligning position, the press portion moves to the retracted position, and the sheet or the sheet bundle is conveyed onto said stacker by moving of the press portion to the aligning position again.

2. A sheet processing apparatus according to claim 1 further comprising a stapler which executes a post-process on the sheet bundle on said process tray.

3. A sheet processing apparatus according to claim 1, wherein said sheet rear end aligning unit includes an idler roller which conveys the sheet or the sheet bundle in cooperation with said conveyor.

4. A sheet processing apparatus according to claim 1, wherein the press portion is a sheet rear end aligning wall which presses and aligns the rear end of the sheet or the rear end of the sheet bundle.

5. A sheet processing apparatus according to claim 4, wherein said sheet rear end aligning unit includes a drive mechanism which rocks said sheet rear end aligning wall.

6. A sheet processing apparatus according to claim 4, wherein said sheet rear end aligning unit includes a drive mechanism which displaces said sheet rear end aligning wall parallel to a sheet conveying direction.

7. A sheet processing apparatus according to claim 1, wherein said stacker has a substantially horizontal sheet-stacking surface.

8. A sheet processing apparatus according to claim 7, wherein said sheet-stacking surface has a downward inclination angle of 18° or less from a horizontal plane toward the press portion of said sheet rear end aligning unit.

9. A sheet processing apparatus according to claim 1, wherein said stacker is vertically movable.

10. An image forming apparatus comprising:

a main body of said image forming apparatus which forms an image on a sheet; and a sheet processing apparatus including:

a process tray on which sheets conveyed from said main body of the image forming apparatus are temporarily stacked, and a post-process is executed;

a stacker on which the sheets or the sheet bundles conveyed from said process tray are stacked;

a conveyor which conveys a sheet or a sheet bundle; and a sheet rear end aligning unit which has a press portion movable between an aligning position to align a rear end of the sheet or a rear end of the sheet bundle by pressing the rear end of the sheet or the rear end of the sheet bundle and a retracted position upstream positioned from the aligning position in a conveying direction; and wherein after said conveyor conveys the sheet or the sheet bundle until the rear end of the sheet or the rear end of the sheet bundle reaches an upper end of the press portion in the aligning position, the press portion moves to the retracted position, and the sheets or the sheet bundle is conveyed on said stacker by moving of the press portion to the aligning position again.

11. An image forming apparatus according to claim 10, wherein said sheet processing apparatus which is connected to a discharge outlet of said main body of the image forming apparatus.

12. An image forming apparatus according to claim 11, further comprising an image reading apparatus to read an image, said image reading apparatus being provided at the upper portion of said main body of the image forming apparatus, wherein the discharge outlet of said main body of the image forming apparatus is positioned in an upper part thereof and formed to discharge the sheets toward a sheet discharge space for sheet discharge, formed in a lower part of said image reading apparatus, and said sheet processing apparatus is provided to be mountable in the sheet discharge space.

13. A sheet processing apparatus comprising:

a process tray on which sheets are temporarily stacked and a post-process is executed;

a stacker on which the sheets or the sheet bundles conveyed from said process tray are stacked;

a conveyor which conveys a sheet or a sheet bundle; and a sheet rear end aligning unit which has a press portion movable between an aligning position to align a rear end of the sheet or a rear end of the sheet bundle by pressing the rear end of the sheet or the rear end of the sheet bundle and a retracted position upstream positioned from the aligning position in a conveying direction; and wherein after said conveyor conveys the sheet or the sheet bundle until the rear end of the sheet or the rear end of the sheet bundle reaches an upper end of the press portion in the aligning position, the press portion moves to the retracted position, and the sheet or the sheet bundle is conveyed onto said stacker by moving of the press portion to the aligning position again.

14. An image forming apparatus comprising:

a main body of an image forming apparatus which forms an image on a sheet;

a process tray on which sheets conveyed from said main body of the image forming apparatus are temporarily stacked, and a post-process is executed;

a stacker on which the sheets or the sheet bundles conveyed from said process tray are stacked;

a conveyor which conveys sheets a sheet or a sheet bundle; and a sheet rear end aligning unit which has a press portion movable between an aligning position to align a rear end of the sheet or a rear end of the sheet bundle by pressing the rear end of the sheet or the rear end of the sheet bundle and a retracted position upstream positioned from the aligning position in a conveying direction; and wherein after said conveyor conveys the sheet or the sheet bundle until the rear end of the sheet or the rear end of the sheet bundle reaches an upper end of the press portion in the aligning position, the press portion moves to the retracted position, and the sheet or the sheet bundle is conveyed onto said stacker by moving of the press portion to the aligning position again.

* * * * *

UNITED STATES PATENT AND TRADEMARK OFFICE

CERTIFICATE OF CORRECTION

PATENT NO. : 6,994,339 B2
APPLICATION NO. : 10/429804
DATED : February 7, 2006
INVENTOR(S) : Katsuhito Kato et al.

It is certified that error appears in the above-identified patent and that said Letters Patent is hereby corrected as shown below:

COVER PAGE AT ITEM [56] RC:
Foreign Patent Documents: "2000153954 A" should read --2000-153954 A--.

COLUMN 16:
Line 31, "its" should read --their--.

COLUMN 4:
Line 3, "is" should be deleted.
Line 31, "a" should be deleted.

Signed and Sealed this

Twenty-second Day of August, 2006

JON W. DUDAS
*Director of the United States Patent and Trademark Office*